US007341207B2

(12) United States Patent
Hubmann

(10) Patent No.: US 7,341,207 B2
(45) Date of Patent: Mar. 11, 2008

(54) VARIABLE WATER FLOW AND DILUTION CHEMICAL DISPENSER

(75) Inventor: Curtis H. Hubmann, Racine, WI (US)

(73) Assignee: JohnsonDiversey, Inc., Sturtevant, WI (US)

( * ) Notice: Subject to any disclaimer, the term of this patent is extended or adjusted under 35 U.S.C. 154(b) by 305 days.

(21) Appl. No.: 11/017,393

(22) Filed: Dec. 20, 2004

(65) Prior Publication Data

US 2006/0131335 A1 Jun. 22, 2006

(51) Int. Cl.

| | |
|---|---|
| ***A62C 5/02*** | (2006.01) |
| ***A62C 13/62*** | (2006.01) |
| ***E03C 1/08*** | (2006.01) |
| ***B05B 1/30*** | (2006.01) |

(52) U.S. Cl. ..... 239/310; 239/307; 239/308; 239/354; 239/398; 239/428.5; 239/569

(58) Field of Classification Search ..... 239/310, 239/307, 308, 337, 344, 354, 373, 378, 398, 239/413, 428.5, 318, 569

See application file for complete search history.

(56) References Cited

U.S. PATENT DOCUMENTS

| | | | | |
|---|---|---|---|---|
| 1,491,202 | A * | 4/1924 | Early | 239/416.4 |
| 1,860,417 | A * | 5/1932 | Hume | 73/39 |
| 1,920,721 | A | 8/1933 | Tirrell | 299/84 |
| 2,588,255 | A * | 3/1952 | Larsh | 239/310 |
| 3,042,314 | A * | 7/1962 | Packard et al. | 239/347 |
| 3,632,046 | A | 1/1972 | Hengesbach | 239/318 |
| 4,475,689 | A | 10/1984 | Hauger et al. | 239/318 |
| 4,508,272 | A | 4/1985 | Thompson | 222/464 |
| 4,846,220 | A * | 7/1989 | Rader | 137/564.5 |
| 4,901,923 | A | 2/1990 | McRoskey et al. | 239/123 |
| 5,320,288 | A | 6/1994 | Ketcham, Jr. | 239/316 |
| 6,450,374 | B1 | 9/2002 | Lohr | 222/482 |
| 6,708,901 | B2 | 3/2004 | Hubmann et al. | 239/310 |
| 6,772,914 | B2 | 8/2004 | Hubmann et al. | 222/153.09 |

FOREIGN PATENT DOCUMENTS

| | | |
|---|---|---|
| JP | 09001001 | 7/1997 |
| WO | WO 02/36267 A1 | 5/2002 |

* cited by examiner

*Primary Examiner*—Davis Hwu
(74) *Attorney, Agent, or Firm*—Gregory S. Bollis; Neil E. Hamilton

(57) ABSTRACT

A dispenser for mixing and dispensing a liquid chemical concentrate from a container with a stream of diluting water. The dispenser includes two valve members which control in one instance the water flow and in another instance the amount of concentrate being siphoned into the water flow. The dispenser is of a simplified design yet can afford a variety of different chemical concentrations, as well as various flow rates of the water.

10 Claims, 5 Drawing Sheets

VARIABLE WATER FLOW AND DILUTION CHEMICAL DISPENSER

CROSS-REFERENCES TO RELATED APPLICATIONS

Not applicable.

STATEMENT REGARDING FEDERALLY SPONSORED RESEARCH

Not Applicable.

BACKGROUND OF THE INVENTION

The field of the invention is dispensers for chemical concentrates, and particularly the dispensing of chemical concentrate at multiple flow rates and different concentrations.

Dispensers of the type concerned with in this invention are disclosed in U.S. Pat. No. 4,508,272; No. 5,320,288; No. 6,708,901; and International Patent Publication No. WO 02/36267.

The dispensers disclosed in U.S. Pat. No. 4,508,272; No. 5,320,288; No. 6,749,133 and WO 02/36267 do not provide for the control of the flow rate of water through the dispenser. The adjustment of concentrate into the water flow is accomplished by a rotational port 82 in the '272 patent, a control member 110 in the '288 patent, a rotation of insert 700 in the '133 patent, and by metering orifices 22 in WO 02/36267.

The dispenser disclosed in U.S. Pat. No. 6,708,901 provides for both the control of water flow rate and concentrate. However, there may be a need for alternative ways of controlling water flow rate and chemical concentrate. For example, operators may prefer to have separate flow dials for these functions rather than the single one provided in U.S. Pat. No. 6,708,901.

SUMMARY OF THE INVENTION

The present invention provides a dispenser for dispensing different concentrations of chemical concentrate into a stream of water from a concentrate container and at different flow rates. The dispenser includes a body member having a through bore with an inlet end adapted to be connected to a source of pressurized water at one end and an outlet at the opposite end. A first valve member is in fluid communication with the through bore of the body member. The first valve member is constructed and arranged to provide at least two different flow rates. There is a second valve member in fluid communication with the through bore and the concentrate container. The second valve member is constructed and arranged to provide at least two different amounts of concentration of chemical concentrate into the through bore. The first and second valve members are accessible from outside the body member.

In a preferred embodiment, the first valve member is constructed and arranged to provide two different flow rates.

In one aspect, the second valve includes three flow passages to provide three different flow rates and the through bore is connected to the chemical concentrate container.

In another aspect, the outlet is constructed and arranged to fill a bucket, a bottle or to receive a foam nozzle and the body member is adapted to be held by a human hand.

In another preferred embodiment, the first valve member includes a flow control device.

A general object of the invention is to provide a dispenser for dispensing different concentrations of chemical concentrate wherein both the flow rate of water and chemical concentrate are independently controlled from each other.

Another object is a dispenser of the foregoing type wherein the flow rate of water and chemical concentrate are controlled by individual valve members.

Still another object is a dispenser of the foregoing type wherein individual valve members are controlled by dials positioned on the same side of the dispenser.

Yet another object is a dispenser of the foregoing type which is easily operated.

Still another object is a dispenser of the foregoing type which is economical to produce.

DETAILED DESCRIPTION OF THE PREFERRED EMBODIMENT

Figure 1:
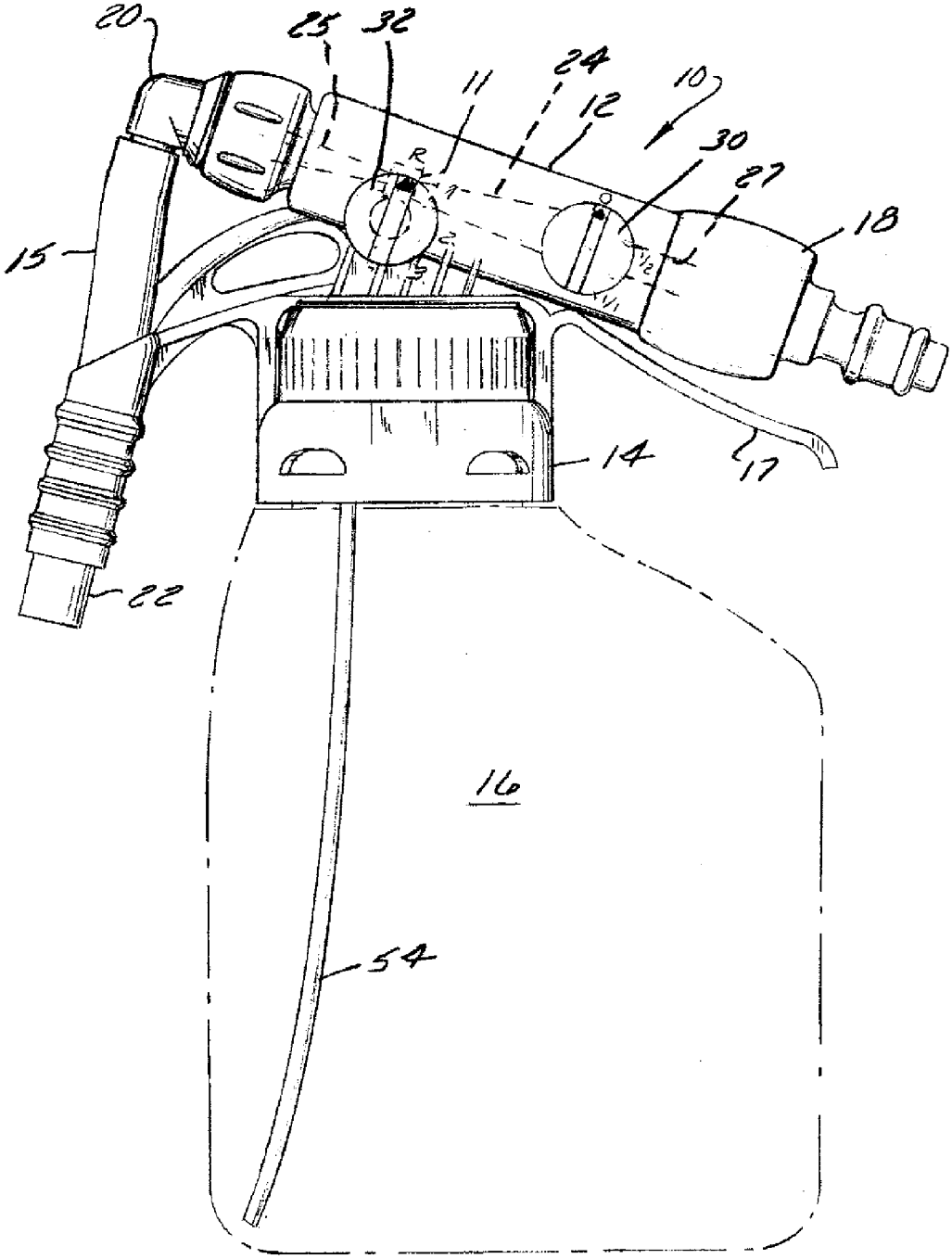
FIG. 1 is a side view of the dispenser of this invention.
Figure 2:
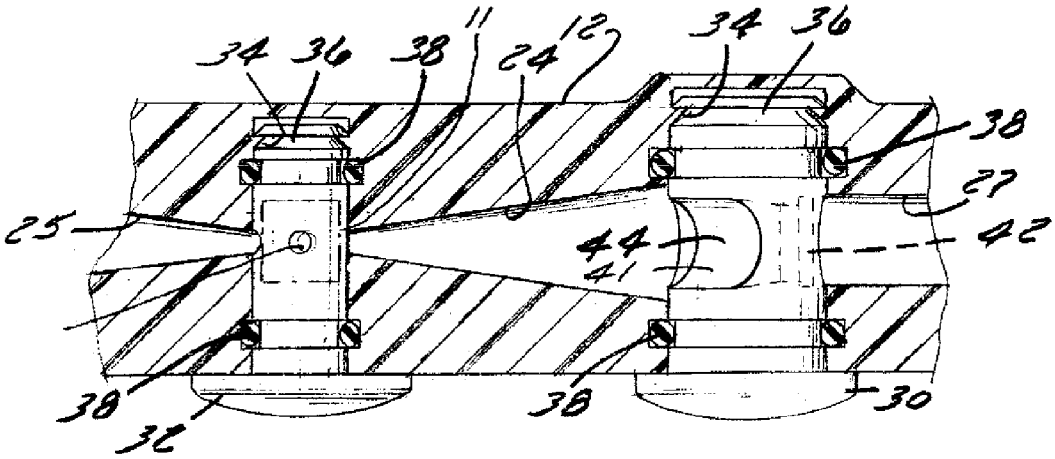
FIG. 2 is a partial, horizontal cross-sectional view of the dispenser illustrating the flow control valves.
Figure 3:
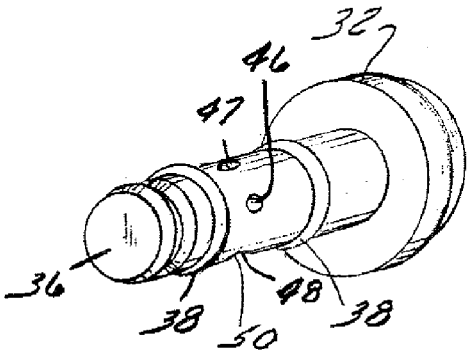
FIG. 3 is a perspective view of a flow control valve for controlling concentrate.
Figure 4:
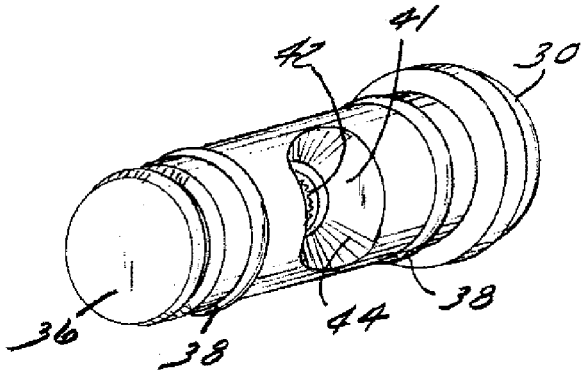
FIG. 4 is a view similar to FIG. 3 illustrating the flow control valve for controlling water flow.

Referring to FIGS. 1 and 2, the dispenser generally 10 has a body member 12 with a container connector 14 for connection to a container or bottle 16. A preferred connector system is more fully described in commonly owned U.S. Pat. No. 6,772,914, which teachings are incorporated herein. At one end of the body member 12 is a hose attachment 18 for supplying pressurized water to the dispenser. A handle 17 is provided below attachment 18. At the other end there is the spout 22 and a nozzle 20 for dispensing a mixed chemical solution. A flexible tube 15 extends between nozzle 20 and spout 22.

As seen in FIG. 2, body member 12 includes a converging passage 24 and a diverting passage 25 interconnected by an eductor portion 11. A through bore 27 interconnects with the converging and diverging passages 24 and 25. Rotatably mounted in body 12 is a valve member 30 which controls the flow of water through the through bore 27 and the passages 24 and 25. There is also rotatably mounted therein a second valve member 32 which controls the amount of chemical concentrate introduced into the water stream in diverting passage 25. These valve members are rotatably mounted in the body member by means of the flanges 34 and the undercuts 36. Seals 38 are also provided.

Referring to FIGS. 4-7, it is seen that the valve member 30 has a transverse passage 41. Channels 42 and 44 communicate therewith, to provide a passage from the through bore 27 to the converging passage 24.

Referring to FIGS. 3 and 8-11, there is shown the second valve member 32 which controls the amount of concentrate to be siphoned from the container or bottle 16 to the eductor portion 11. Valve member 32 has a multiplicity of passageways such as shown at 46, 47 and 48. These are of varying diameters in order to regulate the amount of concentrate being passed to the eductor portion 11. A reduced diameter portion 50 extends between these orifices. This is best seen in conjunction with FIGS. 8-12.

Figure 13:
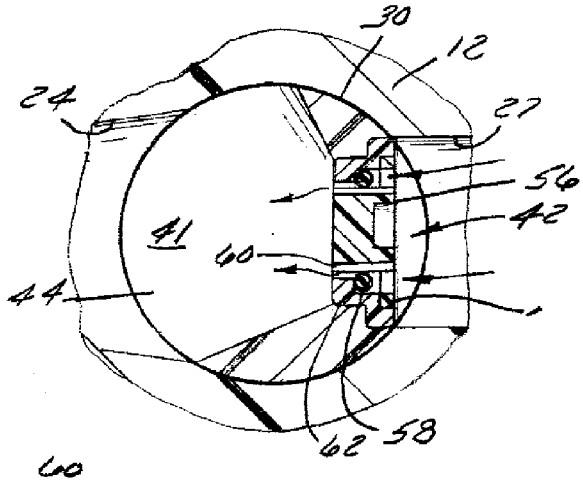
FIG. 13 is a cross-sectional view illustrating a flow control element in one of the valves.
Figure 14:
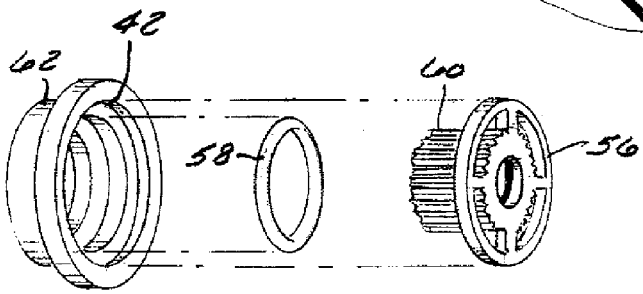
FIG. 14 is an exploded view of the flow control element shown in FIG. 13.

FIGS. 13 and 14 illustrate the use of a flow control device 56 which is available from Neoperl, Inc. located in Waterbury, Conn. It has a multiplicity of grooves 60 which are positioned in annular member 62 with an expandable seal 58 to control the flow of water therethrough in a well-known manner.

OPERATION

Figure 5:
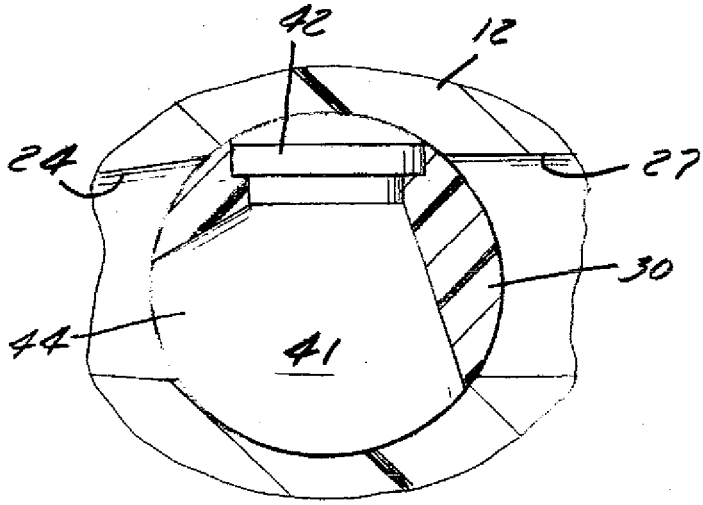
FIGS. 5-7 are partial sectional views illustrating different flow positions for the valve shown in FIG. 4.
Figure 6:
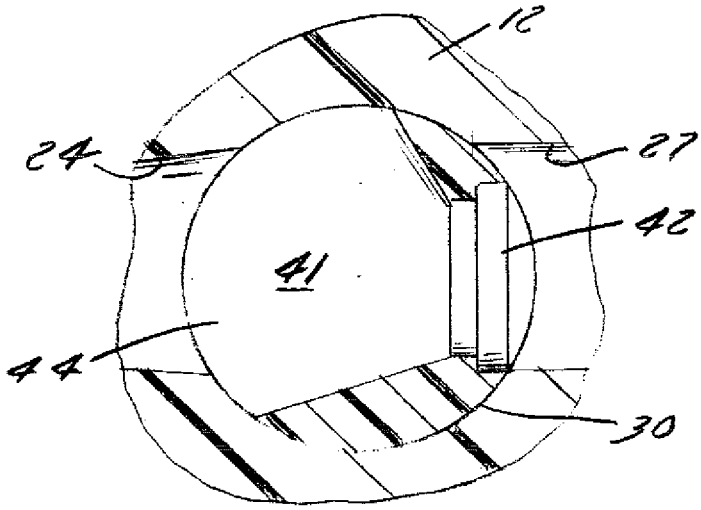
Figure 7:
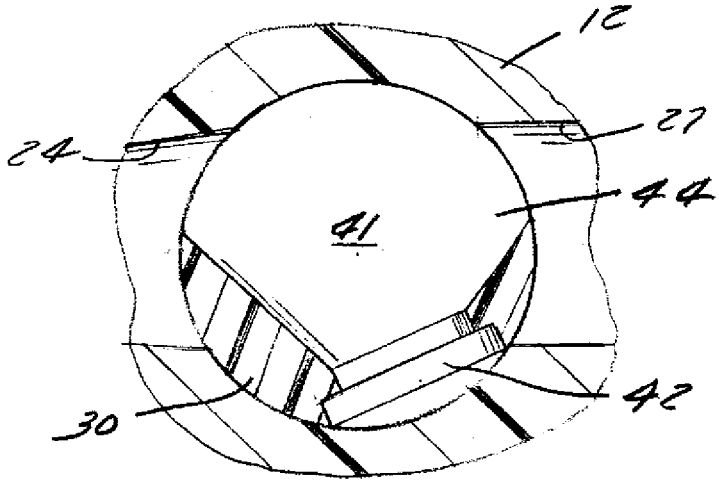
Figure 8:
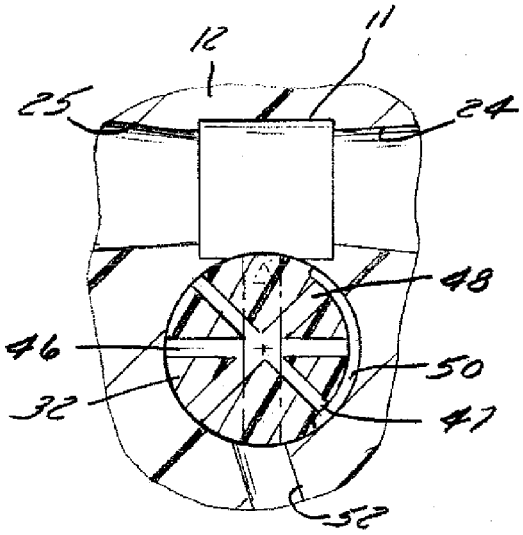
FIGS. 8-11 are views similar to FIGS. 5-7 illustrating different flow positions for the valve shown in FIG. 3.
Figure 9:
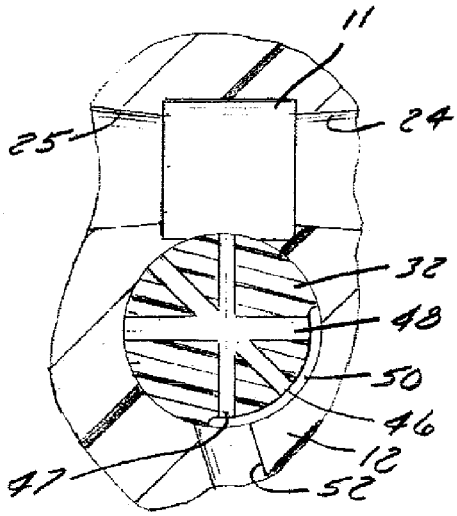
Figure 10:
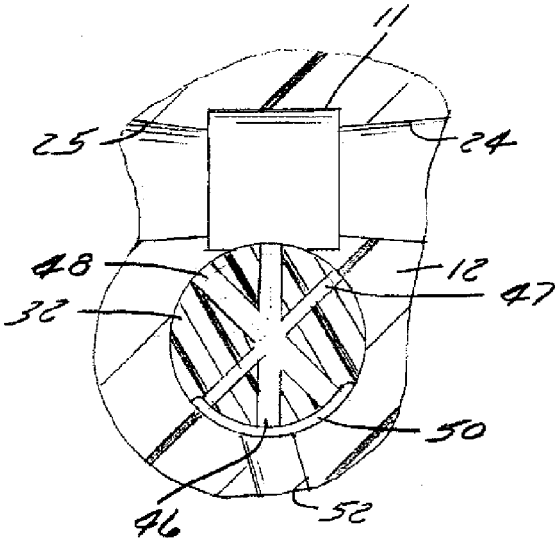
Figure 11:
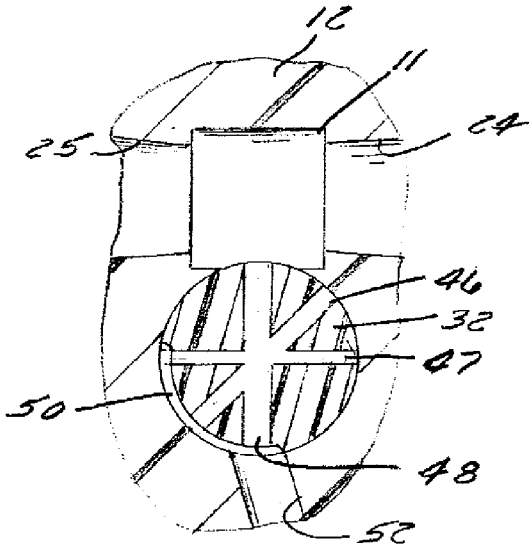
Figure 12:
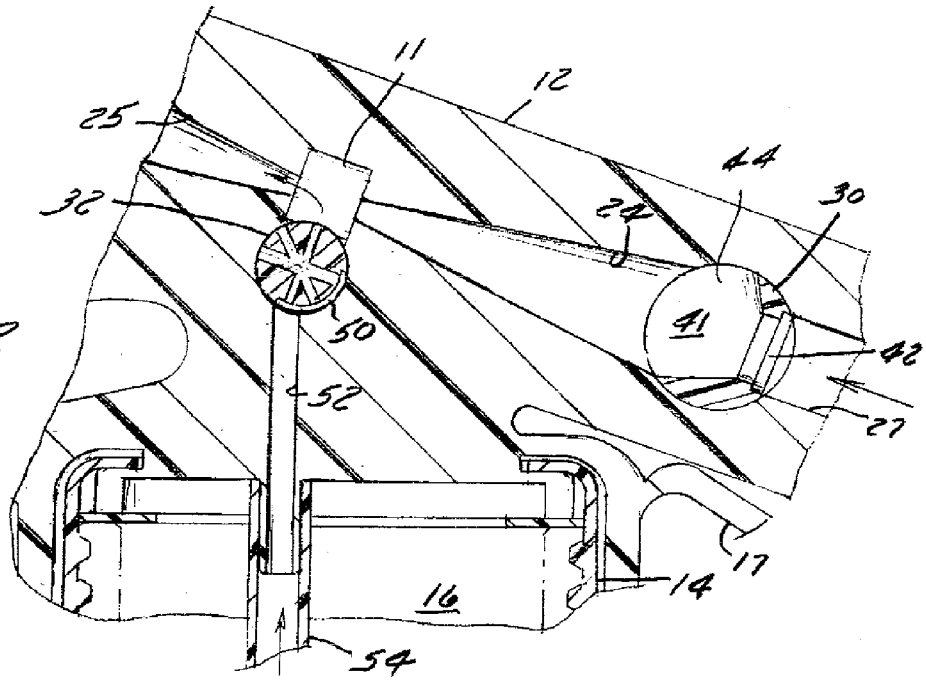
FIG. 12 is a partial, vertical cross-sectional view illustrating the flow control valves.

A better understanding of the dispenser will be had by description of its operation. Referring to FIG. 1, a hose with pressurized water will be connected to hose attachment 18. As seen in FIG. 5, valve 30 is in a closed position as wall 40 of the valve is blocking through bore 27. With valve member 30 rotated in a clock-wise position, channel 42 will be orientated with through bore 27 to allow water to flow into converging passage 24 and diverging passage 25 and accordingly through the eductor portion 11. This is seen in FIG. 6 and effects suction action of concentrate in bottle 16 to draw concentrate up through dip tube 54 and into passage 52 as seen in FIG. 12. There it is introduced into one of the three passages, 46, 47 or 48 of valve member 32. As seen in FIG. 8, valve member 32 is in a closed position. This enables a shipping stop position for no chemical contact. In FIGS. 9, 10 and 11 the passages 46, 47 and 48 are orientated between the eductor portion 11 and the passage 52 to provide flow of concentrate into the eductor portion 11. Concentrate flows from passage 52 into the reduced diameter portion 50 and subsequently into the passages 46 and 47. These passages are of varying diameters so as to control the amount of concentrate being siphoned into the eductor portion 11.

The amount of water flowing through passages 24, 25 and the eductor portion 11 is controlled by the valve member 30. As seen in FIG. 6, channel 42 provides a regulated flow condition, whereas in FIG. 7 an unregulated flow condition is effected. This is accomplished by the different sizes of channels 42 and 44.

In the instance where it is desired to control the flow of water at a steady rate, the flow control 56 is placed in the passage 42. This affords a steady flow rate.

The designations R, 1, 2 and 3 and ½, 1/1 in FIG. 1 indicate various flow rates for valve 30 and 32, respectively, with "R" indicating a rinse position.

If desired, a foam producing nozzle such as described in U.S. patent application Ser. No. 10/348,161 filed Jan. 21, 2003 can be attached to nozzle 20. In such instance, nozzle 20 would have a forwardly facing outlet, rather than a downwardly facing one.

It will also be seen that there is now provided a dispenser for chemical concentrate which is of a simplified design, yet can afford control of both the water flow and the amount of concentrate being siphoned into the water stream. The dispenser is easily operated as both valve members are positioned on the same side of the dispenser body. This allows the user to hold it with one hand and make any adjustments with the other, never having to let go of the dispenser. Further, while the second valve member 32 has been illustrated as a rotary valve member with three passages of different diameters, a needle type valve could be substituted to provide at least two different amounts of chemical concentrate into through bore 27.

The dispenser has been shown in conjunction with a particular type of nozzle and spout. These are not necessary to provide the advantages as previously described for the dispenser. A simple straight forward nozzle can be connected to diverging passage 25. Neither is it necessary to have the connector 14, the handle portion 17 nor the flow control 56. All such and other modifications within the spirit of the invention are meant to be within its scope, as defined by the appended claims.

What is claimed is:

1. A dispenser for dispensing different concentrations of chemical concentrate into a stream of water from a concentrate container at different flow rates comprising:

a body member having a through bore with an inlet end adapted to be connected to a source of pressurized water at one end and an outlet at the opposite end;

a first valve member in fluid communication with the through bore of the body member, the first valve member constructed and arranged with at least two different sized and independent flow channels to provide at least two different flow rates of pressurized water;

a second valve member in fluid communication with the through bore and the concentrate container, the second valve member constructed and arranged to provide a least two different amounts of concentration of chemical concentrate into the through bore; and the first and second valve members being rotatably positioned on the body member and accessible from outside the body member.

2. The dispenser of claim 1 wherein the second valve member is constructed and arranged to provide three different flow rates.

3. The dispenser of claim 2 wherein the second valve member includes three flow passages of different diameters.

4. The dispenser of claim 1 wherein the through bore is connected to the chemical concentrate.

5. The dispenser of claim 4 wherein the through bore is connected to the chemical concentrate by means of a dip tube in a container.

6. The dispenser of claim 1 wherein the outlet is constructed and arranged to fill a bucket, a bottle or to receive a foam nozzle.

7. The dispenser of claim 1 wherein the body member is adapted to be held by a human hand.

8. The dispenser of claim 7 wherein the first and second valve members are controlled by control dials positioned on a side of the body member, with both dials located on the same side.

9. The dispenser of claim 1 wherein the inlet end is adapted to be connected to a hose.

10. The dispenser of claim 1 wherein the first valve member includes a flow control device.

* * * * *